United States Patent [19]

Borgstrom

[11] Patent Number: 4,799,895

[45] Date of Patent: Jan. 24, 1989

[54] 600-AMP HOT STICK OPERABLE SCREW-ASSEMBLED CONNECTOR SYSTEM

[75] Inventor: Alan D. Borgstrom, Hackettstown, N.J.

[73] Assignee: Amerace Corporation, Parsippany, N.J.

[21] Appl. No.: 64,849

[22] Filed: Jun. 22, 1987

[51] Int. Cl.[4] ..... H01R 13/53

[52] U.S. Cl. ..... 439/183; 439/784; 439/805; 439/921

[58] Field of Search ..... 439/784, 801, 805, 638, 439/641, 642, 643, 88, 89, 181, 183–187, 476, 477, 479, 480, 483, 484, 921

[56] References Cited

U.S. PATENT DOCUMENTS

| | | | |
|---|---|---|---|
| 3,835,439 | 9/1974 | Yonkers | 439/187 |
| 3,853,375 | 12/1974 | McClain | 439/89 |
| 3,918,786 | 11/1975 | Chaney et al. | 439/480 |
| 4,202,591 | 5/1980 | Borgstrom | 439/185 |
| 4,354,721 | 10/1982 | Luzzi | 439/921 |

*Primary Examiner*—David Pirlot
*Attorney, Agent, or Firm*—David Teschner

[57] ABSTRACT

A high-voltage cable is fixed to the single leg of a 600-amp "T" connector, which in turn is coupled for non-removable engagement with an insulating bushing fixed to a wall of the apparatus housing it is to serve. A removable screw-applied link member selectively couples the remaining leg to the apparatus bushing whereby power is supplied to the apparatus only when the link is present and isolates the cable when it is absent. A bushing extender and novel contact extenders fix the positions of components and serve to align the two arms of the link. Each of the arms includes an externally threaded stud for engagement with the contact extenders which are positioned in the "T" leg and bushing extender such as to engage the studs before interface interference to assist and guide the screw assembly of such parts. By this system, the apparatus and cable can be tested, grounded and a visible break performed without moving the high-voltage cable.

9 Claims, 6 Drawing Sheets

600 AMP HOT STICK OPERABLE SCREW-ASSEMBLED CONNECTOR SYSTEM

BACKGROUND OF THE INVENTION

1. Field of the Invention

The invention is directed to the field of high voltage separable connector systems and more particularly to a 600-amp stick-operable connector system used to interengage electrical apparatus with high voltage cable.

2. Description of the Prior Art

Proper maintenance procedures in high voltage systems involving transformers or switches and cable systems require that the system be de-energized and isolated by opening the switches at both ends of the cable run. The cable system is then tested to ascertain that it is actually de-energized and then each phase is grounded at both ends to prevent injury should the cable system become accidentally energized. Finally, the cables are removed from the switch or transformer bushings to achieve a visible break between the cables and their respective bushings.

To support the cables when not engaging the apparatus bushing, an insulating bushing on a parking stand is employed adjacent the apparatus bushing. Despite their relative closeness, the great weight and stiffness of the 600-amp cable and elbow, the tight dressing of the cable and the size of the cable vault make the two-man operation of moving the cable between apparatus bushing and parking stand difficult. One man must support the cable weight while the second one removes the assembly screw mechanism and again when the screw mechanism is employed to hold the cable in its new position. Further, the weight of the cable-connector assembly and the absence of any assembly guides increase the chance of cross threading the assembly screws necessitating the complete replacement of the connectors, bushings and other affected parts. One prior art system shown in U.S. Pat. No. 3,918,786 issued Nov. 11, 1975 entitled "Electrical Connector Apparatus" by D. P. Chaney et al. shows an electrical connector apparatus having an insulated, conductive link assembly for disconnectably coupling a pair of high voltage electrical cables. The electrical coupling was effected by way of conductive studs formed at the end portions of a link having a plurality of resilient extending fingers mateably received by sockets disposed within the cable connectors. A jack assembly comprising a pivotably-mounted frame with a lifting washer and a catch assembly coupled to the link for receiving the lifting washer facilitates the insertion and retraction of the link assembly.

The device of the patent is not self-assembling and the jack assembly must remain locked in place for the cables to be assembled. Also, because of the closed link arrangement, there is no ability to direct access and test the cables and link for energization nor ground the components during assembly or disassembly to prevent injury to an operator if the cables should be inadvertently energized. Also, the pin and socket do not provide the uniform contact desired to minimize current density. If the contacts are cocked or the loading is not uniform or the contact segments or fingers are not even, then the current density will vary, giving potential hot spots. Also, dirt, moisture or other contaminants decrease the contact between the fingers and the socket walls altering the contact resistance and thus current transfer and heat generated.

SUMMARY OF THE INVENTION

The present invention overcomes the difficulties noted above with respect to prior art 600-amp stick operable connector systems by providing an easily movable link mechanism screw-operated to selectively interengage a fixed 600-amp high voltage cable, with connector attached, with the bushing of an electrical apparatus so that one man can isolate, test, ground and make a visual break between such cable and apparatus quickly and easily without the need to move the cable with its connector.

To achieve this result, the T connectors (of the type shown in U.S. Pat. No. 4,202,591 issued May 13, 1980, and assigned to the assignee of the instant invention) of the 600-amp cable is fixed to the apparatus wall using a dead-end plug in one arm of the T cross-bar. A novel contact extender fixes the T-connector in place and provides means for joining the link mechanism. A bushing extender is similary fixed to the apparatus bushing using another of the novel contact extenders and provides the second means for joining the link mechanism. So fixed, both the T-connector and bushing extender remain unmovable unless they are intentionally removed for maintenance.

The link mechanism is made up of two loadbreak-reducing tap plugs (as shown in the aforesaid U. S. Pat. No. 4,202,591 issued May 13, 1980) joined by a buss bar and insulated. The tap plugs each include an assembly screw operable by a tool inserted through the loadbreak mechanism. The novel contact extenders provide a guide means for proper alignment of the assembly screws to reduce the possibility of cross-threading. Further, the contact extenders are so dimensioned that assembly screw engagement occurs prior to any interference created by engagement of the mating surfaces of the T-connector, bushing extender and tap plugs easing assembly and alignment.

With the link mechanism in place, a continuous path exists between the high voltage cable and the apparatus bushing. The taps provide a readily accessible means of testing and grounding the cable and apparatus, and when the link is removed, the visible break is immediately recognizable. It is an object of this invention to provide a novel screw-operated interconnect system between a high voltage cable and an electrical apparatus.

It is another object of this invention to provide a novel interconnect system between a high voltage cable and an electrical apparatus which is achieved without moving the cable.

It is a further object of this invention to provide a novel interconnect system between a high voltage cable and an electrical apparatus employing a selectively screw applyable connecting link.

It is still another object of this invention to provide a novel interconnecting link comprising two loadbreak-reducing tap plugs joined by an insulated buss bar.

It is yet another object of this invention to provide a novel contact extender for the assembly of the component parts of a novel interconnect system which provides a guide for the assembly of the major screw parts.

It is an object of this invention to provide a novel interconnect system for a high voltage cable and an electrical apparatus comprising a T-connector connected to a high voltage cable and connected by an insulating plug in one arm of the T to the wall of the apparatus enclosure, a bushing extender coupled to the apparatus bushing and a link mechanism made up of two loadbreak-reducing tap plugs joined by an insulated buss bar selectively screw connected to said bushing extender and the second arm of the T-connector by contact extenders which position, guide and align the assembly screws of the tap plugs.

Other objects and features of the invention will be pointed out in the following description and claims and illustrated in the accompanying drawings which disclose, by way of example, the principles of the invention and the best mode which has been contemplated for carrying it out.

BRIEF DESCRIPTION OF THE DRAWING

In the drawings in which similar elements are given similar reference characters.

DESCRIPTION OF THE PREFERRED EMBODIMENT

Figures 1, 2:
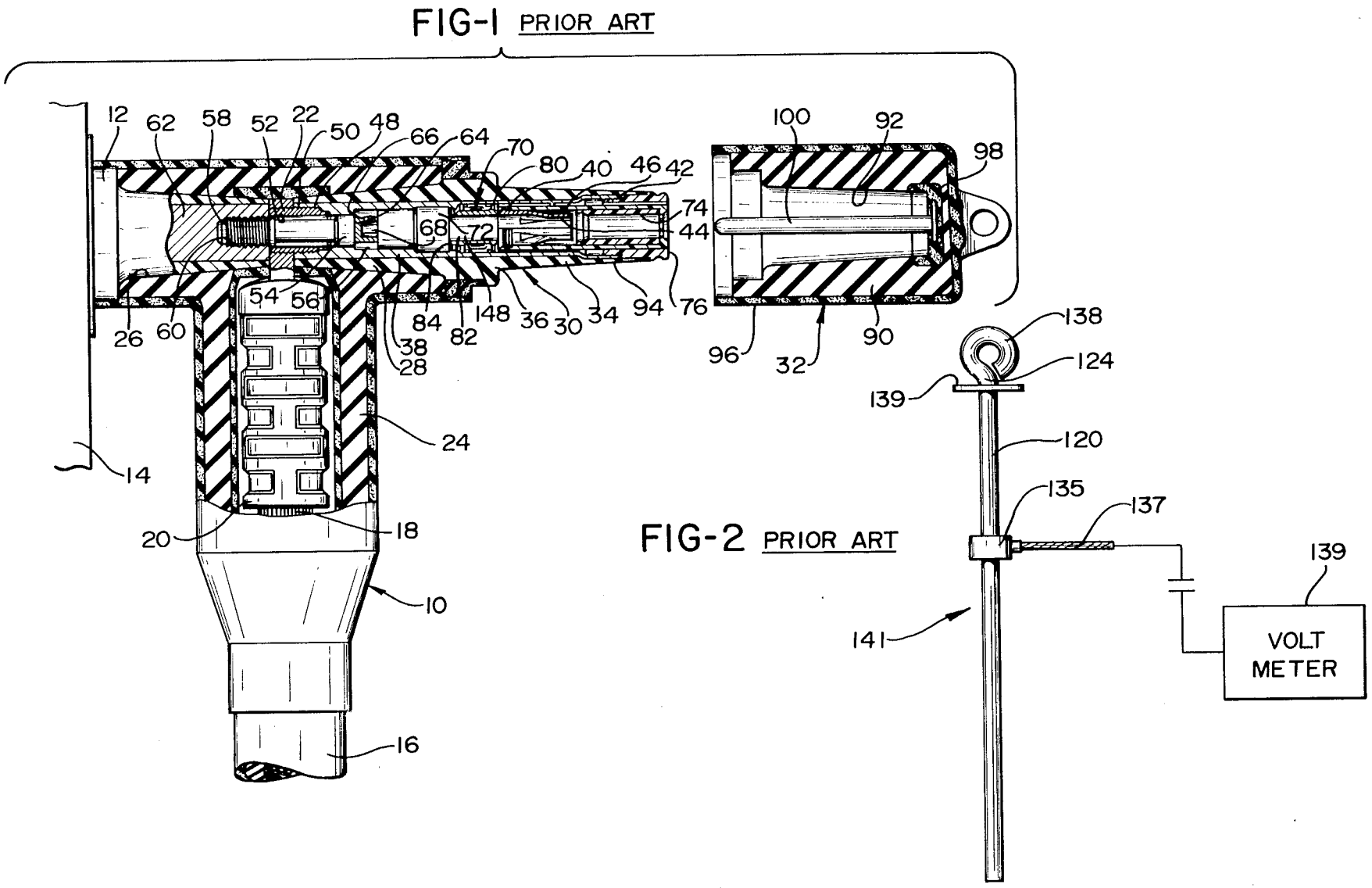
FIG-2 PRIOR ART
FIG-1 PRIOR ART
FIG. 1 is a fragmentary side elevation, partly in section and exploded, showing a high voltage cable, and a T-connector assembled to an apparatus bushing by a loadbreak-reducing tap plug according to the teachings of the prior art and is FIG. 1 of U.S. Pat. No. 4,202,591 issued May 13, 1980.
FIG. 2 is a side elevation of a voltage test probe according to the prior art.

Turning first to FIGS. 1 to 5, the operation of cable-apparatus interconnect systems according to the prior art practices is set forth. The central conductor 18 of a high voltage cable 16 is crimped to an electrical terminal contact 20 and placed in the long leg of a T-shaped receptacle or connector 10. One arm of connector 10 is placed on apparatus bushing or terminal 12 of a high voltage power distribution transformer 14 and the connector 10, contact 20 and terminal 12 are joined by means of the screw assembly 48, 58 of loadbreak reducing tap plug or interface bushing assembly 30 as is more fully described in U.S. Pat. No. 4,202,591 issued May 13, 1986. An insulating cap 32 seals the assembly and prevents accidental contact with any of the activated parts.

Although the description herein generally treats the apparatus bushing as connected to the source of power and the cable as being the power receiver, the two could be reversed as is often the case in the field. The cable may be carrying the power to a distribution transformer connected to the apparatus bushing and thus the apparatus bushing is the receiver of the power from the cable as the source. In order to service the cable system, the switchgear (not shown) controlling the transformer 14 will be opened and locked out with suitable locks and visible markers (not shown). The three phases (only one of which is shown) of the cable system must be isolated, tested, grounded and a visible break established. It may also be required that the three phases of the transformer 14 must be tested and grounded; this can be done once the cables 16 are physically removed from the terminals 12 and parked on parking stands as will be described with reference to FIG. 5.

Cap 32 is removed with a "hot stick" of the type well known in the art and a voltage probe 141 (shown in FIG. 2) consisting of a metal rod 120 with opposite ends 122 and 124 arranged respectively to engage hexagonal socket 68 of assembly bolt 54 and in the form of a ring 138 to be positioned by means of a hot stick. A collar 135 joins conductor 137 from volt meter 139 to the rod 120. With end 122 of rod 120 in the socket 68 of bolt 54, the presence of voltage in the cable 16 and terminal 12 can be detected on completing the testing phase. If no voltage is detected, the joint can be grounded and the cable 16 together with T-connector 10 and tap plug 30 can be removed from terminal 12.

Figure 3:
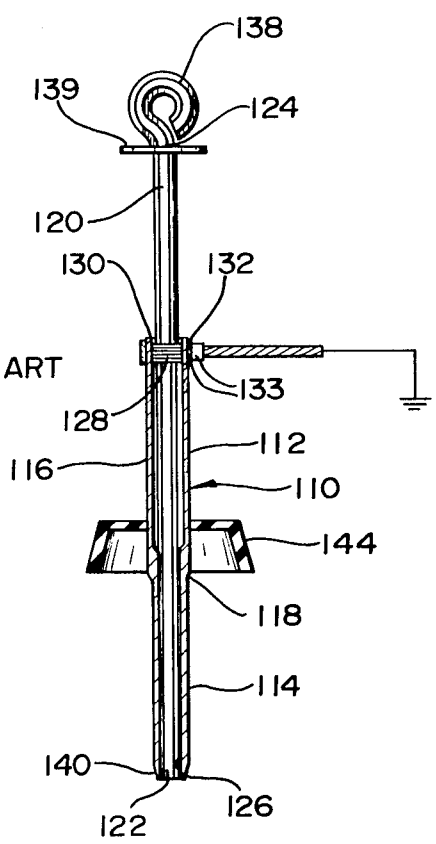
FIG-3 PRIOR ART
FIG. 3 is a side elevation of a tool and grounding rod according to the prior art and is FIG. 2 of U.S. Pat. No. 4,202,591.
Figure 4:
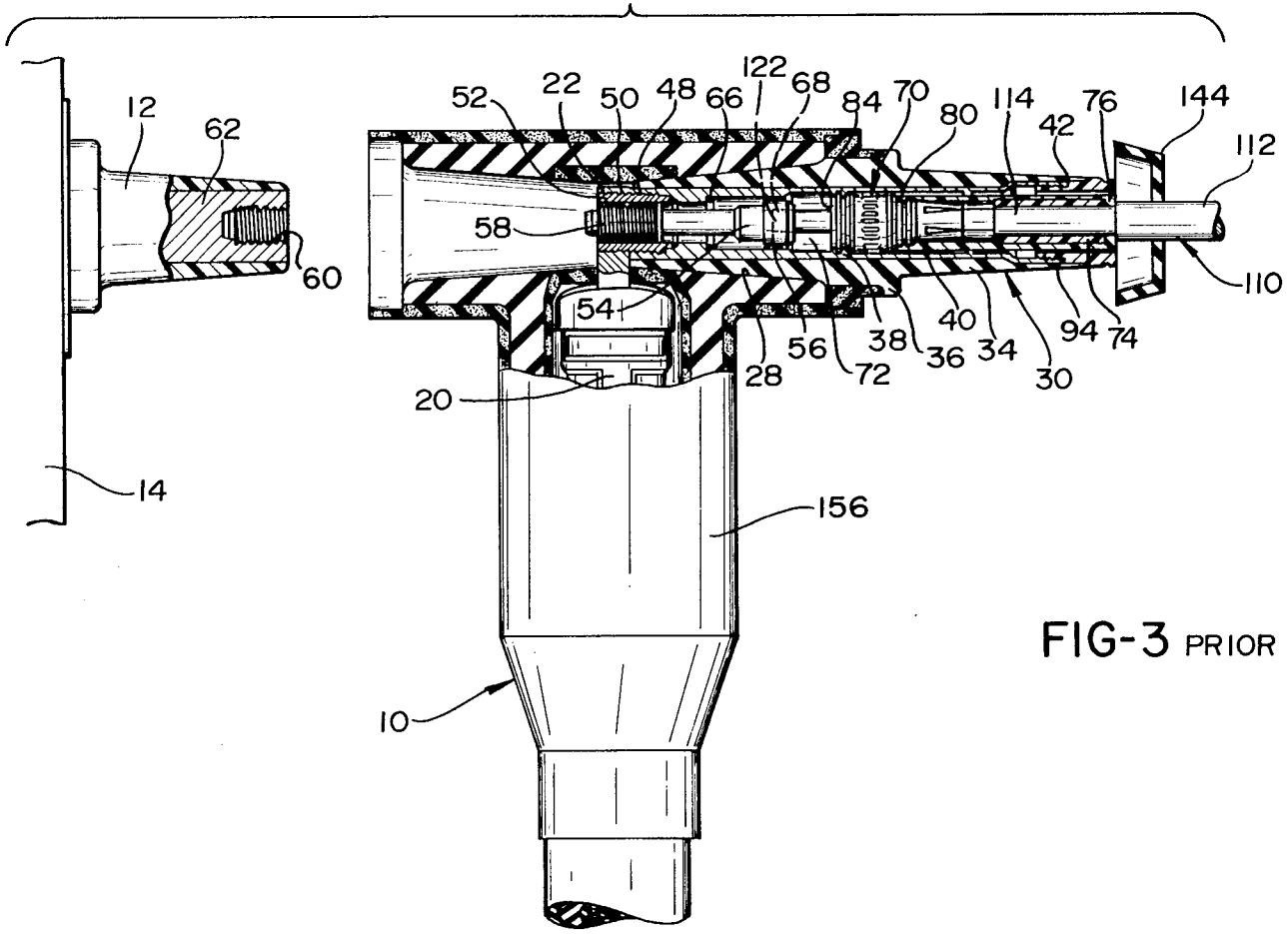
FIG-4 PRIOR ART
FIG. 4 is a fragmentary, side elevation, partly in section and exploded, of the high voltage cable, T-connector, tap plug and tool of FIG. 3 separated from the shown apparatus housing according to prior art practices and is FIG. 5 of said 4,202,591 patent.

The grounding and removal is carried out by tool 110 as shown in FIG. 3 and described in detail in the aforesaid patent. In summary, tool 110 is positioned into tap plug 30 by means of a hot stick and its grounded sleeve 112 grounds female contact element 44 and terminal conductor 62. This completes the grounding phase and begins the visual separation step. The engagement of the complementarily-shaped end 122 of rod 120 with hexagonal socket 68 permits bolt 54 to be withdrawn from internally threaded portion 60 of terminal 12 permitting cable 16, T-connector 10 and tap plug 30 to be removed from terminal 12 (see FIG. 4) by means of a second hot stick with clamshell clamp operated by a second man.

The assembly is then placed on a stand-off plug 180 positioned in a parking stand 192 and the bolt 54 used to fasten the assembly to plug 180. Stand-off plug 180 has a body portion 182 configured to mate with receptacle recess 26 and is joined to a support 186 by fastener 184 but is insulated therefrom. A slot 188 is arranged to engage the arms 194 of parking stand 192. Bolt 190 is used to lock stand-off plug 180 in parking stand 192 by engaging the transformer 14 wall. The parking stand 192 is insulated from the transformer 14. Once positioned on the parking stand 192, a grounded elbow of the type shown in U.S. Pat. No. 4,175,815 issued Nov. 27, 1979 and assigned to the assignee of the instant invention may be inserted into the exposed end of tap plug 30 to protect persons working in the cable in case the cable is inadvertently activated. The cable is now visibly separated or there is a visible break as required by safety practices for the industry. The same steps are carried out for each cable phase and at both cable ends. The transformer 14 may now be similarly tested and grounded if desired.

Once the cable repairs or modifications have been completed, the cables 16 may be reapplied to the terminals 12. One line man with hot stick equipped with clamshell clamp moves the T-connector 10 adjacent the terminal 12 while a second line man with a hot stick attached to a tool 110 inserted into tap plug 30 tries to join bolt 54 thread 58 with internal thread 60 of terminal 12. The weight of cable 16, T-connector 10, tap plug 30, its stiffness and limited range of movement makes cross threading of bolt 54 with terminal 12 quite likely resulting in the required replacement of tap plug 30 or terminal 12 since they can no longer be joined. In the case of terminal 12, the transformer 14 will have to be removed from service, while the oil is drained, the covers removed, the terminal 12 replaced, the transformer sealed and the oil coolant replaced.

Turning now to FIGS. 6 to 10, a 600-amp stick-operated connector system according to the present invention is shown which overcomes the difficulties referred to above with respect to present systems and which enables a single line man to perform all of the described cable functions quickly, easily and safely with little chance of damaging the component parts. Broadly stated, the instant system fixes the position of the heavy, stiff 600-amp cable and does not require its movement to carry out any of the required functions. The apparatus bushing also remains fixed during all operations. The only component which is moved is a relatively light, easily moved screw-operated link member. When in place, this link member joins the 600-amp cable and the apparatus bushing while facilitating the testing and/or grounding of the apparatus bushing or cable. When removed, it provides for isolation of the 600-amp high voltage cable and apparatus bushing, it provide a visual break, it permits the independent testing and grounding of the cable and the apparatus bushing and it can be grounded at any and all stages of its assembly to the cable and bushing.

Figure 6:
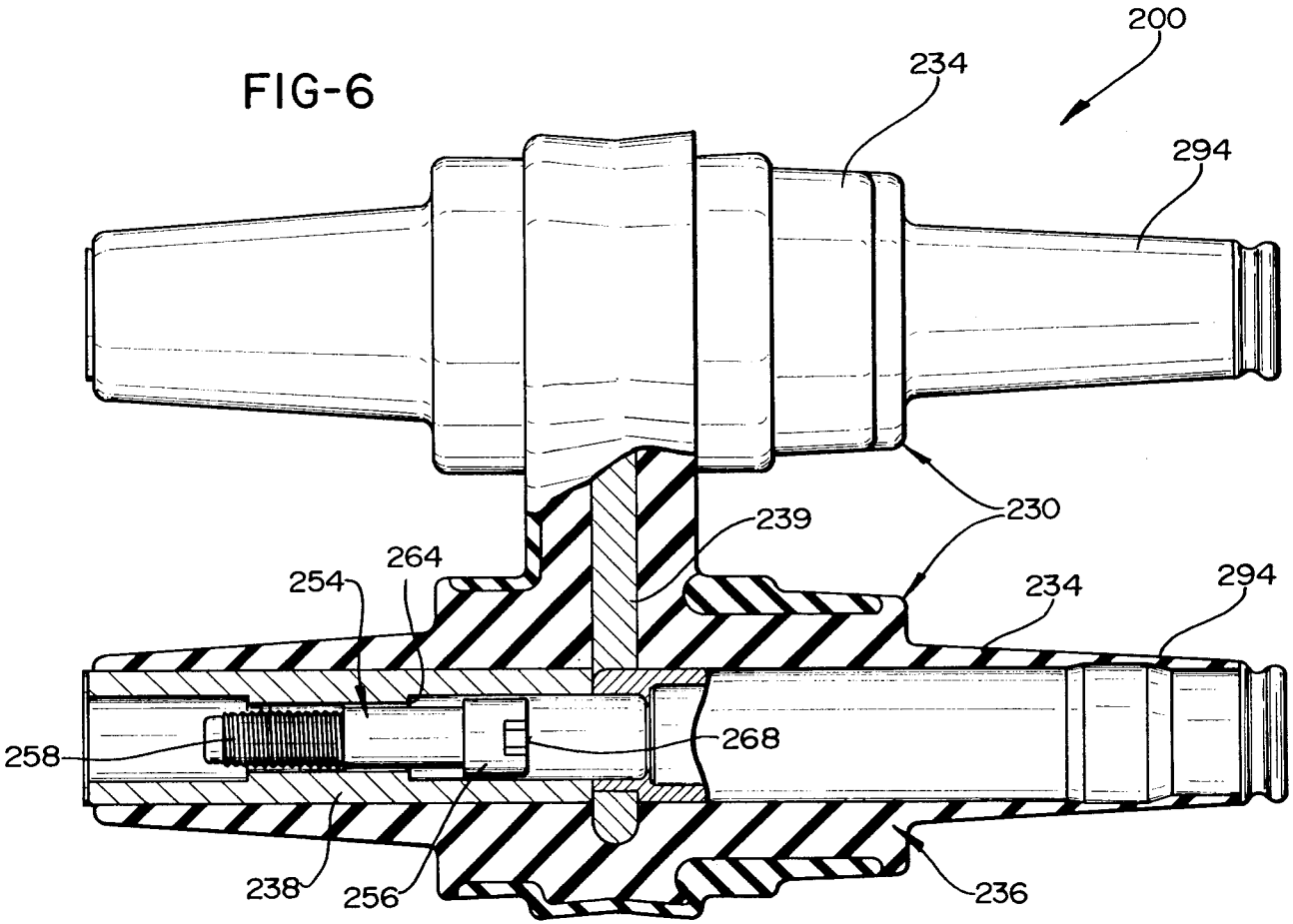
FIG. 6 is a side elevation, partly in section, of a link portion of the novel interconnect system constructed in accordance with the concepts of the invention.
Figure 5:
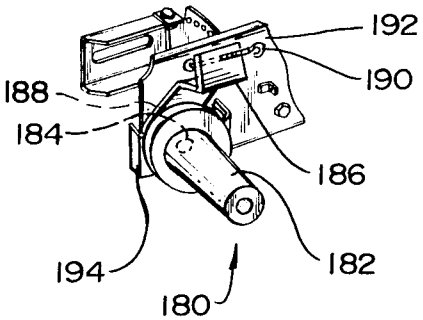
FIG-5 PRIOR ART
FIG. 5 is an isometric view of a stand-off plug positioned in a parking stand according to the prior art.

FIG. 6 shows the link 200 which is effectively two, parallel loadbreak reducing tap plugs or interface bushing assemblies 230 of the type generally shown and described in previously identified U.S. Pat. No. 4,202,591. Each assembly 230 has a generally tubular housing 234 having a member 236 made of dielectric material and a central tubular member 238 of conductive material (only one of which is shown). A buss bar 239 of conductive material such as copper or aluminum joins each of the members 238. A threaded fastener in the form of a bolt 254 is positioned adjacent one end of member 238 to engage the contact extender as will be described below. Threaded sleeve 48 has been omitted in that its function is assumed by the contact extender. A hexagonal socket 268 in the head 256 of bolt 254 permits the use of testing, grounding and assembly tools such as 110 and 141 previously described and operated through the loadbreak mechanism as described in the said U.S. Pat. No. 4,202,591.

Figure 7:
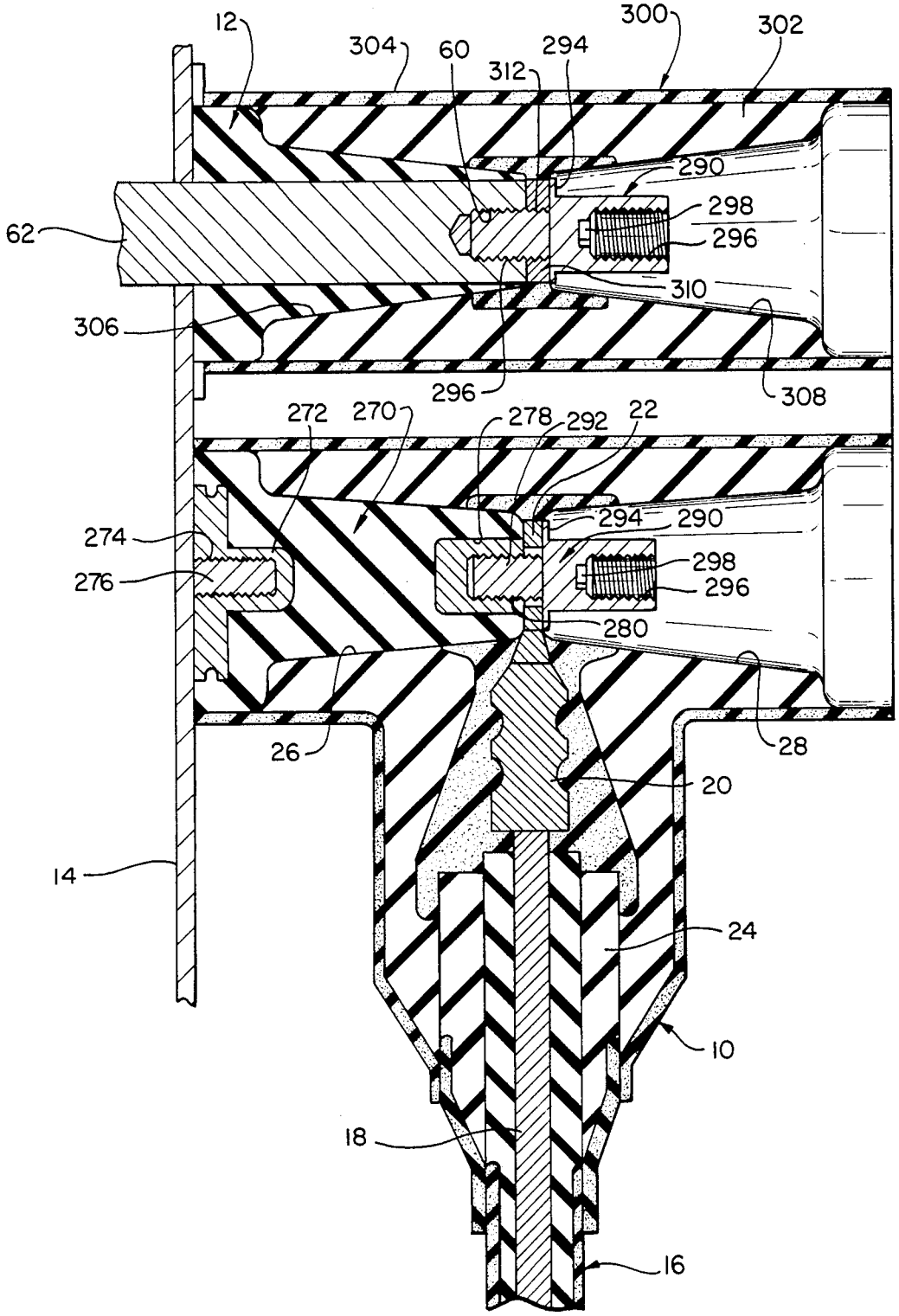
FIG. 7 is a fragmentary, side elevation, in section, of a T-connector, bushing extension, dead-end plug, bushing and cable assembled by contact extenders according to the concepts of the invention.

Referring to FIG. 7 there is shown a representation of a portion of the wall of transformer 14 with an apparatus bushing or terminal 12 affixed thereto. Bushing 12 has a conductive portion 62 with a threaded aperture 60 for receipt of the externally threaded portion of a bolt 54 or a contact extender as described below. The body of bushing 12 is insulating and contoured for receipt in the receptacle recess of components such as the T-connector 10 or the like.

Also connected to the wall of transformer 14 is a dead-end insulator plug 270. Plug 270 is of the same general size and contour as bushing 12 and is constructed of insulating material such as rubber, elastomeric or epoxy. A metallic portion 272 abuts its larger end and a second metallic portion 278 abuts its smaller end. A threaded aperture 274 in portion 272 accepts a threaded stud 276 welded to the wall for assembly of plug 270 to such wall. A threaded aperture 280 in metallic portion 278 accepts the contact extender 290 externally threaded stud 292 for assembly of lug 22 of crimp connector 20 crimped to the metallic conductor 18 of high voltage cable 16. Flange 294 urges lug 22 against the end of dead-end insulator plug 270 inserted in receptacle recess 26 of T-connector 10 and the threaded stud portion 292 engaging internally threaded aperture 280 in metallic portion 278 holds, in assembly, the T-connector 10, the high voltage cable 16 and the plug 270. Under normal conditions, this connection will not be disturbed and the high voltage cable 16 will remain essentially clamped through an insulator to the wall of transformer 14. If necessary for maintenance, the contact extender 290 can be removed so that the T-connector 10 and cable 16 can be detached.

Figure 8:
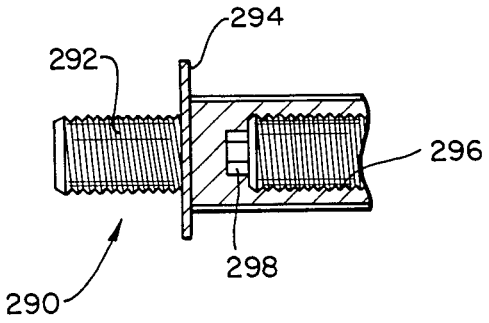
FIG. 8 is an enlarged side elevation of a contact extender of FIG. 7.
Figure 9:
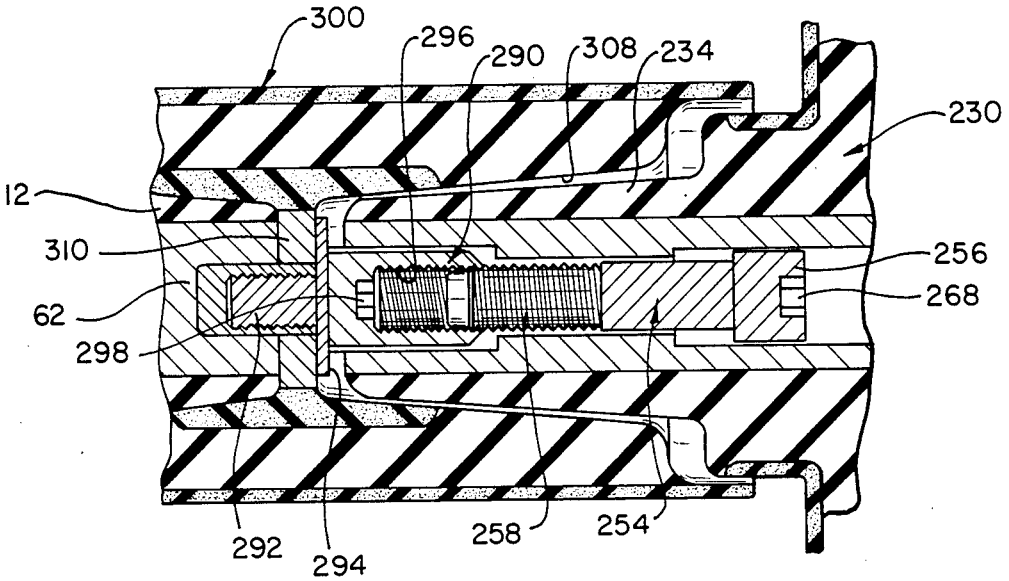
FIG. 9 is a fragmentary, side elevation, in section, of the partial assembly of T-connector and tap plug by means of the contact extender of FIG. 8.

As shown in greater detail in FIG. 8, contact extender 290 has a hexagonal socket 298, similar to the socket 268 in bolt 254 of FIG. 6 to permit the contact extender 290 to be applied or removed by tools such as 110 or 141 shown in FIGS. 2 and 3 herein. An internally threaded recess 296 is arranged to receive assembly bolt 254 of the link 200 as will be described hereinafter.

Returning now to FIG. 7, it is evident that socket 298 of contact extender 290 in T-connector 10 can be reached through receptacle recess 28 which is also arranged to receive a tap plug 230 with assembly bolt 254 engaging threaded recess 296 to assemble tap plug 230 with T-connector 10.

Because of the length of the T-arm of T-connector 10, the second tap plug 230 of link 200 could not contact terminal 12 if the first tap plug 230 were inserted into receptacle recess 28 of T-connector 10. To compensate for this disparity of length, a bushing extender 300 is employed. Bushing extender 300 has a generally cylindrical body portions 302 of insulating material covered with a layer of semi-conducting material 304 as is well known in the art. Receptacle recesses 306 and 308 open inwardly to a central metallic plug 310 having a threaded aperture 312 therethrough and a portion of semi-conducting material 314 thereabout for stress control, also as is well known in the art. The thickness of plug 310 is equal to that of lug 22 of connector 20 of T-connector 10. A contact extender 290 is used to assemble bushing extender 300 to terminal 12 in a generally permanent manner, except when it is necessary for maintenance purposes to service the bushing extender 300 or the terminal 12. The contact extender 290 is applied via recess 308 employing a tool such as 110 or 141. Flange 294 urges plug 310 against the end of terminal 12 and threaded stud 296 engaging threaded aperture 60 of conductive portion 62 of terminal 12 holds the bushing extender 300 in assembly with terminal 12.

In the arrangement of FIG. 7, the high voltage cable 16 is fixed to the wall of transformer 14 and the apparatus bushing 12 is similarly fixed to the wall of transformer 14 but no connection is made therebetween. A pair of matched receptacle recesses 28 and 308 equally spaced from the wall of transformer 14 are available. It should be noted that for safety purposes, tap plugs 30 may be plugged into recesses 28 and 308 capped with insulating caps 32.

To eliminate or greatly reduce the cross-threading problem, the contact extender 290 is arranged to be engaged by the bolt 254 of the tap plug 230 before the nose of housing 234 engages the receptacle recess 308 and creates the sealing interference which results from the engagement of two dry, reasonably large elastromeric surfaces. Sufficient play is present to allow lateral, vertical and circular movement of the tap plug 230 to align bolt 254 with the internally threaded portion 296 of contact extender 290 and the guide portion 296 is sufficiently long that when the bolt 254 is correctly aligned, it is guided well into itself. Once started, bolt 254 can be tightened to fully seat the tap plug 230 in the receptacle recess 308. The same is, of course, true of the attachment bolt 254 to the contact extender 290 in the T-connector 10 recess 28.

Figure 10:
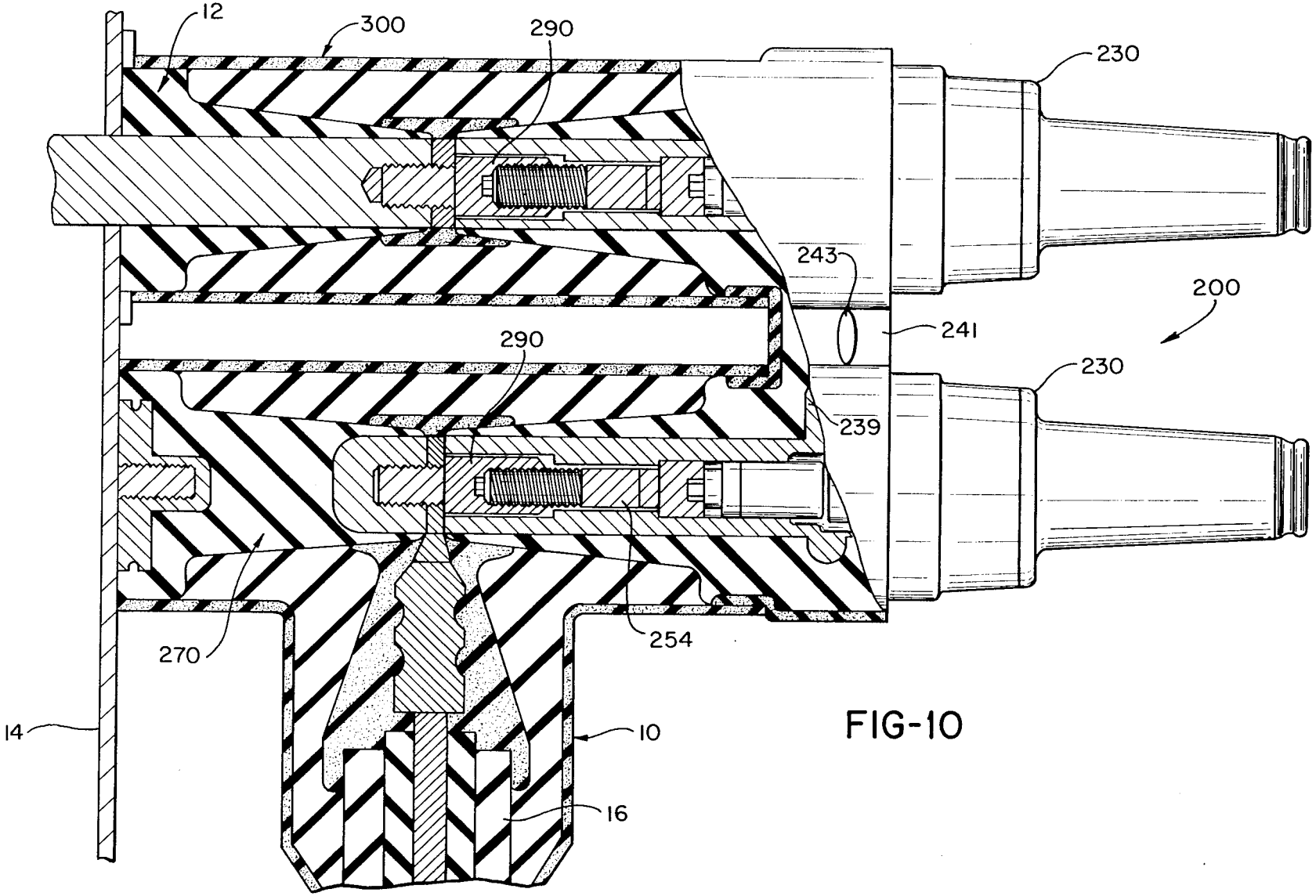
FIG. 10 is a fragmentary, side elevation, partially in section, showing a completed interconnect between a high voltage cable connected to a T-connector and an apparatus bushing employing the bushing extender, contact extenders and link assembly according to the concepts of the invention.

FIG. 10 shows the link 200 in position joining the high voltage cable 16 in T-connector 10 to the transformer 14 terminal 12 and in condition to be tested or grounded as previously described. To protect the tap plugs 230 and prevent contact with any exposed portions, insulated caps 32 are placed on each of the tap plugs 230. If desired to enhance the visibility of the link 200 in place, the insulation about the buss bar 239 can be colored red or yellow or striped.

If disassembly of the link 200 is required, as generally described above, the transformer switch or switch gear is de-energized and locked out with suitable locks and marked with appropriate markers.

The insulated cap 32 of one tap plug 230 is removed and the tool 141 of FIG. 2 is used to test for the presence of voltage. Assuming the test shows no voltage, a grounded loadbreak elbow of the type shown in the aforesaid U.S. Pat. No. 4,175,815 is installed to the exposed tap plug 230. This prevents injury to the line men should the cable system inadvertently activated. Now the insulated cap 32 of the other tap plug 230 is removed and the bolt 254 is removed using the grounding and installation tool 110 of FIG. 3. Once tool 110 is removed, a grounding elbow is connected to this tap plug 230 and the first grounding elbow is removed. The bolt 254 of this tap plug 230 is now disengaged by use of tool 110. The link 200 is now free of the cable 16 and the terminal 12 but is still grounded. The link 200 can now be removed with an appropriate hot stick (not shown) engaging the eye 243 mounted by band 241 over the link 239 to complete the visible break.

While there have been shown and described and pointed out the fundamental novel features of the invention as applied to the preferred embodiment, it will be understood that various omissions and substitutions and changes of the form and details of the devices illustrated and in their operation may be made by those skilled in the art, without departing from the spirit of the invention.

The embodiments of the invention in which an exclusive property or privilege is claimed are defined as follows:

1. A high voltage hot-stick operable screw-assembled connection system for selectively coupling together a source of high voltage and a high voltage cable comprising:

a support member;

an apparatus bushing mounted upon said support member and electrically coupled to a source of high voltage;

a high voltage cable mounted upon said support member and electrically insulated therefrom and a selectively applicable screw-operated link member when applied in a first arrangement joining said apparatus bushing to said cable to apply high voltage thereto or, when not applied between said apparatus bushing and said cable, providing a visible separation between said bushing and said cable; said screw-operated link member comprising a first and a second housing assembly each containing a metallic insert, one of said first and said second housing assemblies screw coupled to said apparatus bushing and the other screw coupled to said high voltage cable and a conductive metal buss coupling said metallic inserts of said first and said second housing assemblies.

2. A high voltage hot-stick operable screw-assembled connection system for selectively coupling together a source of high voltage and a high voltage cable comprising:

a support member;

an apparatus bushing mounted upon said support member and electically coupled to a source of high voltage;

a high voltage cable mounted upon said support member and electrically insulated therefrom and a selectively applicable screw-operated link member when applied in a first arrangement joining said apparatus bushing to said cable to apply high voltage thereto or, when not applied between said apparatus bushing and said cable, providing a visible separation between said bushing and said cable; said screw-operated link member comprising:

a first and a second housing assembly, each having a bore extending from a first end to a second end of said housing assemblies;

a metallic insert in each of said first and second housing assemblies extending from said first end to said second end of said housing assemblies;

first screw means, one for each of said first and second housing assemblies, mounted in said respective metallic inserts adjacent said first ends thereof;

said second ends of each of said metallic inserts being open to admit an assembly tool whereby one of said first and said second housing assemblies can be joined to said apparatus bushing by said screw means in its associated metallic insert and the other housing assembly can be joined to said high voltage cable by said screw means in its associated metallic insert and a conductive metal buss coupling said metallic inserts of said first and said second housing assemblies.

3. A high voltage hot-stick operable screw-assembled connection system for selectively coupling together a source of high voltage and a high voltage cable comprising:

a support member;

an apparatus bushing mounted upon said support member and electrically coupled to a source of high voltage;

a high voltage cable mounted upon said support member and electrically insulated therefrom and a selectively applicable screw-operated link member when applied in a first arrangement joining said apparatus bushing to said cable to apply high voltage thereto or, when not applied between said apparatus bushing and said cable, providing a visible separation between said bushing and said cable; said screw-operated link member comprising:

a first and a second elongate housing of insulating material each having a bore from a first end to a second end thereof;

a hollow, elongate, metallic insert in each of said first and second housings extending from said first to said second ends;

a metallic coupling screw in each of said metallic inserts adjacent said first ends of said housings and operable by a tool inserted in said metallic inserts adjacent said second ends of said housings;

a metallic buss coupling said metallic inserts in said first and second housings; and insulating means insulating said metallic buss from external contact.

4. A high voltage hot-stick operable screw-assembled connector system as defined in claim 2, further comprising contact extender means for coupling one of said first screw means to said apparatus bushing and the second of said first screw means to said high voltage cable.

5. A high voltage hot-stick operable screw-assembled connector system as defined in claim 2, further comprising:

contact extender means for coupling one of said first screw means to said apparatus bushing and the second of said first screw means to said high voltage cable;

each of said contact extender means having a threaded stud portion for engagement with one of said apparatus bushing or said high voltage cable and an internally threaded portion, each to accept and guide one of said first screw means to permit the screw assembly of said respective housing assemblies with one of said apparatus bushing and said high voltage cable.

6. A high voltage hot-stick operable screw-assembled connector system as defined in claim 5, wherein each of said contact extenders has a central body portion between said threaded stud portion and said internally threaded portion; a locking flange about the outside of said body portion; and a recess within said central body portion for receipt of a tool to permit said contact extender to be installed to or removed from said apparatus bushing or said high voltage cable.

7. A high voltage hot-stick operable screw-assembled connector system as defined in claim 6, wherein said internally thread portion is of a length to permit engagement with said first screw means before said first or second housing assemblies engages either said apparatus bushing or high-voltage cable.

8. A high voltage hot-stick operable screw-assembled connector system as defined in claim 1, wherein said high voltage cable is coupled to a T-connector having a T-bar extending in parallel with said first and second housing assemblies; dead-end plug means coupled to said support member and said T-connector to support and position said high voltage cable.

9. A high voltage hot-stick operable screw-assembled connector system as defined in claim 8, further comprising bushing extender means coupled to said apparatus bushing and projecting from said supporting member a distance equal to the T-bar of said T-connector to permit said link member to join said high voltage cable and said apparatus bushing.

* * * * *

UNITED STATES PATENT AND TRADEMARK OFFICE

CERTIFICATE OF CORRECTION

PATENT NO. : 4,799,895

DATED : January 24, 1989

INVENTOR(S) : Borgstrom

It is certified that error appears in the above—identified patent and that said Letters Patent is hereby corrected as shown below:

In the Specification:

Col. 2, line 20, change "similary" to --similarly--.

Col. 7, line 36, after the word "system" insert --be--.

Signed and Sealed this

Twenty-ninth Day of May, 1990

*Attest:*

HARRY F. MANBECK, JR.

*Attesting Officer*

*Commissioner of Patents and Trademarks*